US006371791B1

(12) United States Patent
Newton, Jr.

(10) Patent No.: US 6,371,791 B1
(45) Date of Patent: Apr. 16, 2002

(54) FILTERED TERMINAL BLOCK ASSEMBLY

(75) Inventor: Robert Lewis Newton, Jr., Elgin, IL (US)

(73) Assignee: Cooper Technologies, Houston, TX (US)

( * ) Notice: Subject to any disclaimer, the term of this patent is extended or adjusted under 35 U.S.C. 154(b) by 0 days.

(21) Appl. No.: 09/803,815

(22) Filed: Mar. 12, 2001

(51) Int. Cl.[7] ..... H01R 13/648

(52) U.S. Cl. ..... 439/383; 439/2; 439/578; 439/620

(58) Field of Search ..... 439/620, 2, 382, 439/383, 384, 578

(56) References Cited

U.S. PATENT DOCUMENTS 3,763,460 A * 10/1973 Hatschek et al. ..... 339/89
4,995,834 A * 2/1991 Hasegawa ..... 439/620
5,046,968 A * 9/1991 Baur et al. ..... 439/620
5,181,864 A * 1/1993 Wakino et al. ..... 439/620
5,213,522 A * 5/1993 Kojima ..... 439/620
5,562,477 A * 10/1996 Moore et al. ..... 439/383
5,701,665 A 12/1997 Kling
5,895,293 A 4/1999 Brandberg et al.
6,059,608 A * 5/2000 Benes ..... 439/620
6,065,992 A * 5/2000 Wu et al. ..... 439/383

* cited by examiner

*Primary Examiner*—Tho D. Ta
*Assistant Examiner*—Truc Nguyen
(74) *Attorney, Agent, or Firm*—Armstrong Teasdale LLP

(57) ABSTRACT

A terminal block assembly include a base assembly includes a terminal block housing and a terminal stud extending therethrough, a filter assembly coupled to the stud; and a ground assembly coupled to the base assembly and the filter assembly for dissipating filtered signals. The filter assembly is mechanically isolated from the base assembly and the ground assembly to prevent structural loading of the filter assembly.

15 Claims, 2 Drawing Sheets

FILTERED TERMINAL BLOCK ASSEMBLY

BACKGROUND OF THE INVENTION

This invention relates generally to terminal block assemblies for electrical power distribution, and, more particularly, to filtered terminal block assemblies for removing undesirable frequencies from electronic signals.

A growing proliferation of electronic devices in modern products and systems can produce unintended and undesirable signal distortion between electrical components, systems and subsystems. While some signal distortion is tolerable in many instances, in certain applications signal distortion is a significant issue that must be controlled, if not overcome. Such applications wherein reduction and/or elimination of signal distortion is desirable include, for example, power supply systems for telecommunication systems, telecommunication switching applications, cellular base stations, radar transmission systems, industrial control systems, and instrumentation systems.

Consequently, a variety of terminal block assemblies have been introduced that include one or more filter elements coupled to electrical terminal elements for removing undesirable frequency transmission through the terminal block. One type of filtered terminal block assembly includes a tubular capacitor element mounted to a terminal stud for filtering a signal through the stud. When electrical connections are made to the terminal stud in the field, however, the tubular capacitor element may be placed under a structural load. Connections to threaded studs render this type of terminal block assembly particularly vulnerable to placing the capacitor element under stress when a wire is fastened to the stud. The resultant stress may damage the capacitor element and adversely affect filtering performance of the terminal block assembly.

BRIEF SUMMARY OF THE INVENTION

In an exemplary embodiment of the invention, a terminal block assembly includes a base assembly including a terminal block housing and a terminal stud extending therethrough, a filter assembly coupled to the stud, and a ground assembly coupled to the base assembly and the filter assembly for dissipating filtered signal frequencies from signals transmitted through the terminal block. The filter assembly is mechanically isolated from the base assembly and the ground assembly to prevent structural loading of the filter assembly.

More specifically, the filter assembly includes a resilient contact member for mechanically isolating the filter assembly from the base assembly and the ground assembly. The terminal stud includes opposite ends configured for electrical connections thereto, and an undercut located between the opposite ends for retaining the resilient contact element. The filter assembly further includes a tubular capacitor element and the resilient contact member establishes an electrical connection with an inner surface of the tubular capacitor element.

Mechanical isolation of the filter element from structural load and associated stress and strain provides an operating environment of the filter element free from negative effects of structural load. Filter performance and reliability of the terminal block assembly is therefore increased in a cost effective manner.

DETAILED DESCRIPTION OF THE INVENTION

Figure 1:
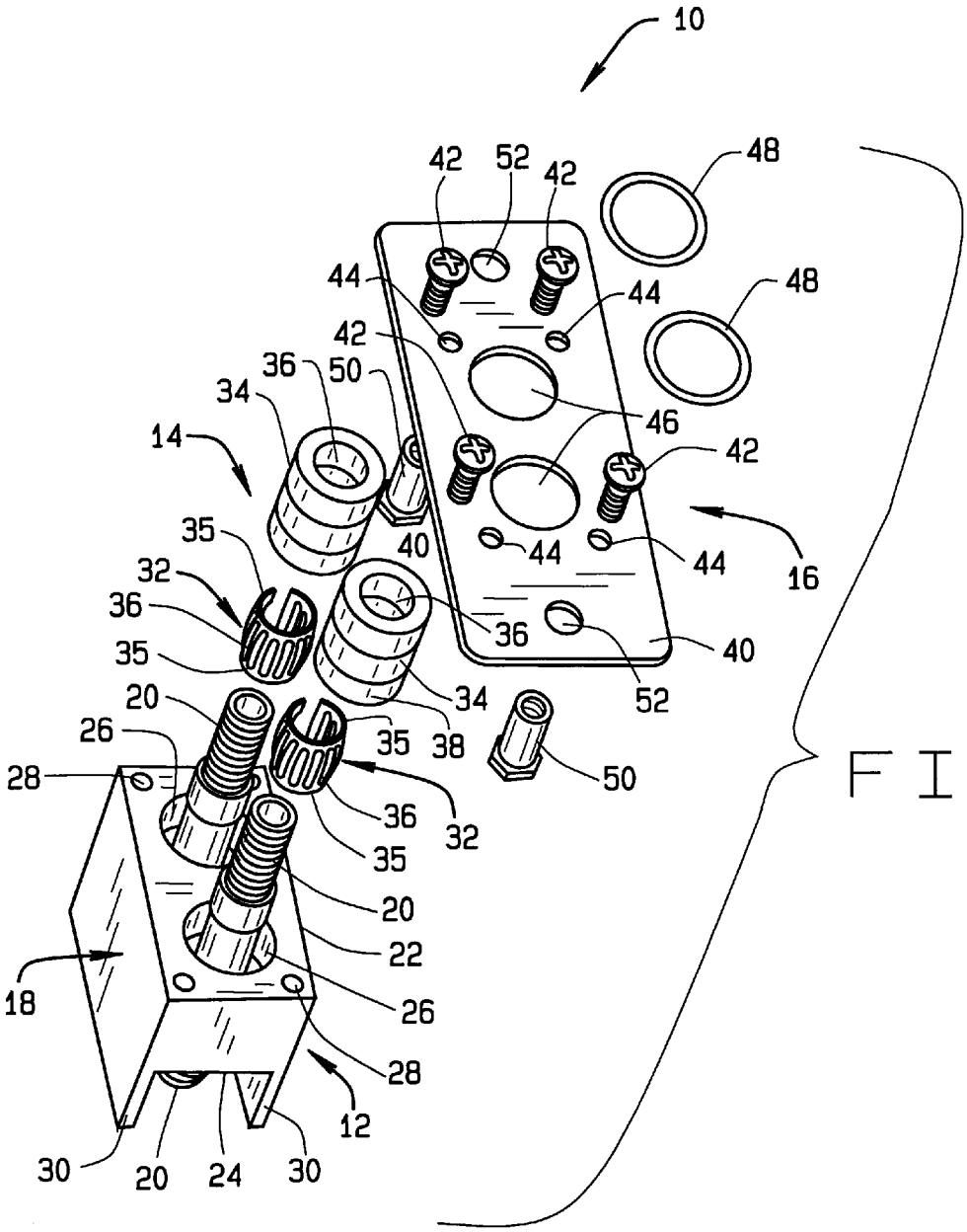
FIG. 1 is an exploded view of a terminal block assembly.

FIG. 1 is an exploded view of a terminal block assembly 10 for transmitting electrical signals from, for example, a power supply source, system or subsystem (not shown) to a power receiving component, system or subsystem (not shown) while filtering undesirable frequencies, electromagnetic interference and noise from the transmitted signal. While terminal block assembly 10 is particularly advantageous for use in connection with high current power supply systems for telecommunication systems, it is contemplated that the advantages of terminal block assembly also accrue to many other applications wherein signal distortion is problematic, including but not limited to telecommunication switching applications, cellular base stations, radar transmission systems, industrial control systems, and instrumentation systems. Therefore, the invention is not intended to be limited to any particular application, and the foregoing end-use applications are set forth for illustrative purposes only.

Terminal block assembly 10 includes a base assembly 12, a filter assembly 14 and a ground assembly 16. Base assembly 10 includes a non-conductive terminal block housing 18 and two electrically conductive terminal studs 20 extending therefrom on opposite sides 22, 24 of housing 18. In an exemplary embodiment, terminal block housing 18 is fabricated from a known plastic or thermoplastic material, and studs 20 are insert molded therein. In alternative embodiments, other dielectric materials are employed to fabricate terminal block housing 18, and studs 20 may be coupled to terminal block housing 18 according to other methods and techniques known to those in the art, such as, for example, a two-piece housing assembly fastened over terminal studs 20.

One side 22 of terminal block housing 18 includes an opening or bore 26 for each stud 20 that receives respective portions of filter assembly 14, further explained herein below. Terminal block housing side 22 further includes a plurality of mounting apertures 28 for receiving fasteners of ground assembly 16, also further explained herein below. Terminal block housing side 24 includes first and second outer walls 30 extending in substantially parallel fashion from side 24 and approximately equally spaced from a longitudinal axis of terminal studs 20.

Terminal studs 20 are each configured for connection to a load side or line side device (not shown) with opposite threaded ends. While the illustrated embodiment includes two studs 20 extending through opposite sides 22, 24 of terminal block housing 18, it is understood that with appropriate modification of terminal block housing 18 to accommodate the respective terminal studs 20, greater numbers of terminal studs 20 may be employed within the scope of the present invention to provide a multiple pole filtered terminal block assembly for a desired end-use application.

Filter assembly 14 includes an electrically conductive resilient contact element 32 and a filter element 34 for each terminal stud 20. Resilient contact elements 32 include opposite ends 35 and a plurality of resilient members 36 extending therebetween. Each end 35 forms an incomplete annulus for insertion over terminal studs 20, and resilient members 36 are slightly outwardly bowed between spring element ends 35 so that resilient contact element 32 flexes with spring-like action to absorb structural loads placed upon filter assembly 14.

In one embodiment, each filter element 34 includes a generally tubular body having an inner surface 36 and an outer surface 38 situated about a central bore through the body. Each of body inner and outer surfaces 36, 38 include separate circuits plated thereon. Capacitive material (not shown) is located between the respective circuits of body inner and outer surfaces 36, 38. When filter elements 34 are placed over terminal studs 20, body inner surfaces 36 are electrically associated with an outer surface of terminal studs 20. A magnetic field generated between surfaces 36, 38 through the capacitive material filters signals of a predetermined frequency from a signal transmitted through terminal studs 20. The filtering capacity of each filter element 34 is dependent upon specific characteristics of filter element 34, and a variety of ratings of filter elements 34 are commercially available from different manufacturers. Thus, a range of frequencies filtered from terminal block assembly 10 may be varied from application for different applications with proper selection of filter elements 34.

In a further embodiment, more than two filter elements 34 may be employed with respective terminal studs 20, and ratings of filter elements 34 may be the same or different from one another to provide a variety of signal filtering options. In alternative embodiments, other known filter elements 34 may be used in lieu of the above-described and illustrated tubular capacitor filter elements.

Ground assembly 16 includes a ground plate 40 and a plurality of fasteners 42 for coupling ground plate 40 to terminal block housing apertures 28 through complementary openings 44 extending through ground plate 40. While in the illustrated embodiment, fasteners 42 are threaded fasteners or screws, it is appreciated that other fasteners and fastening mechanisms known in the art may be employed in alternative embodiments to couple ground plate 40 to terminal block housing 18.

Ground plate 40 further includes a filter element opening 46 for each of filter elements 34 of filter assembly 14. Solder preform 48 is applied about a circumference of filter element openings 46 for bonding and electrically connecting filter element outer surfaces 38 to ground plate 40. Opposite standoffs 50 extend upwardly from either end of ground plate 40 through apertures 52 in ground plate 40. Ground plate 40 provides a parallel path in the electrical circuit through terminal block assembly 10 to dissipate filtered signal portions from filter elements 34.

While in the illustrated embodiment ground plate 40 includes two openings 46 for each filter element 34 of filter assembly 14, greater numbers of terminal openings 46 may be employed within the scope of the present invention to accommodate additional filter assemblies 14 in a multiple pole filtered terminal block assembly. Thus, ground plate 40 may be adapted for a desired end-use application with appropriate modification of terminal block housing 18 to accommodate additional terminal studs 20 and filter elements 34. Still further, additional standoffs 50 may be employed in alternative embodiments, and greater or fewer than the four illustrated fastener openings 44 may be employed to accommodate greater or fewer numbers of fasteners 42. It is also recognized that other shapes of ground plate 40 may be used in alternative embodiments in lieu of the substantially rectangular ground plate 40 illustrated in FIG. 1.

Terminal block assembly 10 is assembled by inserting resilient contact elements 32 over respective terminal studs 20 so that resilient contact elements 32 are positioned in terminal block bores 26 in terminal block housing first side 22. Filter elements 34 are also placed over respective terminal studs 20 and positioned in respective terminal block bores 26 in terminal block housing first side 22. One end 35 of each resilient contact element establishes electrical connection with each filter element inner surface 36. Ground plate 40 is inserted over filter elements 34 and fastened to terminal block housing 18 with fasteners 42. Solder preform 48 is applied to the circumferences of filter element openings 46 in ground plate 40 and solder preform is heated reflowed to bond solder preform 48 to ground plate 40 and filter element outer surface 38, and also to form an electrical connection between ground plate 40 and filter element outer surface 38 for dissipation of filtered signals from filter elements 34. Standoffs 50 are coupled to ground plate 40 to complete assembly of terminal block assembly 10.

Resilient contact elements 32 mechanically isolate filter elements 34 from mechanical loads and associated mechanical stress that may occur, for example, when wires (not shown) are connected to terminal studs 20 above ground plate 40. Resilient contact elements 32 absorb structural loads that would otherwise be placed on filter elements 34. Negative impacts on filter performance due to structural stress and strain on filter elements 32 are therefore avoided.

Figure 2:
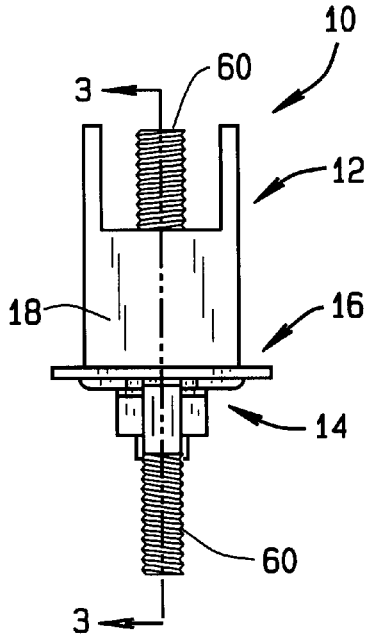
FIG. 2 is a side elevational view of the terminal block assembly shown in FIG. 1 in an assembled condition.

FIG. 2 is a side elevational view of assembled terminal block assembly 10 illustrating filter assembly 14 partially within and partially extending from terminal block housing bore 26 (shown in FIG. 1) and grounding assembly 16 attached to terminal block housing 18. Ends 60 of terminal studs 20 are threaded and therefore configured for coupling to respective connection wires (not shown) with, for example, a known connection member (not shown), such as a nut. Thus, when an electrical circuit is completed through terminal studs 20, predetermined frequency ranges of signals passing therethrough are filtered out by filter assembly 14. Thus, for example, a clean power supply signal, i.e., free of undesirable noise, may be supplied to, for example, telecommunications system equipment.

Figure 3:
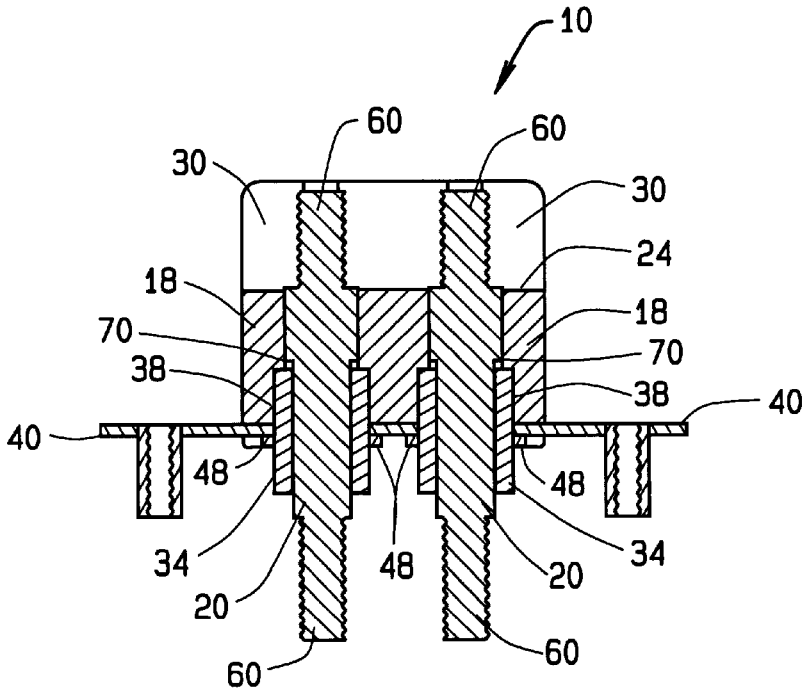
FIG. 3 is a cross sectional view of the terminal block assembly along line 3—3 of FIG. 2.

FIG. 3 is a cross sectional view of terminal block assembly illustrating threaded ends 60 of terminal studs 20 extending through terminal block housing 18. Outer walls 30 extend from terminal block housing side 24.

Each terminal stud 20 includes an undercut 70, or step diameter decrease that acts as a stop for resilient contact member 32 (shown in FIG. 1) and retains resilient contact member 32 between capacitor element 34 and stud undercuts 70. As such, resilient contact member 32 isolates filter element 34 from a structural load when terminal block assembly 10 is installed in the end-use application. Undercuts 70 are located intermediate threaded ends 60 of terminal studs 20 and within terminal block housing 18 adjacent housing bores 26 (shown in FIG. 1). Solder preform 48 is applied and reflowed about filter elements 34 to form an electrical connection between capacitor element outer surface 38 and ground plate 40 for dissipation of filtered signals.

While the invention has been described in terms of various specific embodiments, those skilled in the art will recognize that the invention can be practiced with modification within the spirit and scope of the claims.

What is claimed is:

1. A terminal block assembly comprising:

a base assembly comprising a terminal block housing comprising a bore and a terminal stud extending through said bore;

a filter assembly comprising a resilient contact element and a filter element coupled to said stud; and a ground assembly coupled to said base assembly and said filter assembly for dissipating filtered signals;

wherein said resilient contact element is located between said terminal stud and said filter element so as to mechanically isolate said filter element from said terminal stud to prevent structural loading of said filter assembly.

2. A terminal block assembly in accordance with claim 1 wherein said terminal stud comprises opposite ends configured for electrical connections, and an undercut located between said opposite ends for retaining said resilient contact element.

3. A terminal block assembly in accordance with claim 2 wherein said filter element comprises a tubular capacitor element.

4. A terminal block assembly in accordance with claim 3 wherein said tubular capacitor element comprises an inner surface, said resilient contact member establishing an electrical connection with said inner surface.

5. A terminal block assembly comprising:

a terminal block housing comprising an opening;

a terminal stud extending through said opening;

a filter element coupled to said stud;

a resilient contact element electrically coupled to said filter element and located between said terminal stud and said filter element so as to mechanically isolate said filter element from structural stress.

6. A terminal block assembly in accordance with claim 5 wherein said terminal stud comprises a stop located within said housing for retaining said resilient contact element.

7. A terminal block in accordance with claim 6 wherein said resilient contact element is located between said stop and said filter element.

8. A terminal block assembly in accordance with claim 6 wherein said filter element comprises a tubular capacitor element.

9. A terminal block assembly in accordance with claim 5 wherein said terminal stud comprises a threaded stud.

10. A terminal block assembly in accordance with claim 5 further comprising a ground plate coupled to said terminal block housing.

11. A terminal block assembly in accordance with claim 10 wherein said ground plate is soldered to said filter element.

12. A method for assembling a terminal block assembly including a base assembly, a filter assembly, and a ground assembly, the base assembly including a terminal block housing having an opening and a terminal stud extending therethrough, the filter assembly including a resilient contact element and a filter element; and the ground assembly including a ground plate, said method comprising the steps of:

positioning the resilient contact element over the terminal stud;

positioning the filter element over the resilient contact element and the stud; and coupling the ground plate to the terminal block housing so that the resilient contact element mechanically isolates the filter element from mechanical stress.

13. A method in accordance with claim 12 wherein the terminal block housing includes a filter element bore, said step of positioning the spring contact element comprising the step of positioning the spring contact element within the bore.

14. A method in accordance with claim 13 wherein the terminal stud includes an undercut located adjacent the bore, said step of positioning the spring contact within the bore comprises the step of abutting the resilient contact element to the undercut of the terminal.

15. A terminal block assembly in accordance with claim 14 wherein said step of positioning the filter element over the terminal stud and the capacitor element comprises the step of positioning the capacitor element over the resilient contact element so that an electrical connection is established between the resilient contact element and the filter element.

* * * * *

UNITED STATES PATENT AND TRADEMARK OFFICE

CERTIFICATE OF CORRECTION

PATENT NO. : 6,371,791 B1
DATED : April 16, 2002
INVENTOR(S) : Robert Lewis Newton, Jr.

It is certified that error appears in the above-identified patent and that said Letters Patent is hereby corrected as shown below:

Column 5,
Line 37, delete "6" insert therefor -- 5 --.

Signed and Sealed this

Second Day of December, 2003

JAMES E. ROGAN
*Director of the United States Patent and Trademark Office*